US010815948B2

(12) United States Patent
Göschel et al.

(10) Patent No.: US 10,815,948 B2
(45) Date of Patent: Oct. 27, 2020

(54) ARRANGEMENT OF A FUEL INJECTION VALVE ON A FUEL DISTRIBUTOR OF AN INTERNAL COMBUSTION ENGINE

(71) Applicant: VOLKSWAGEN AKTIENGESELLSCHAFT, Wolfsburg (DE)

(72) Inventors: Marcus Göschel, Braunschweig (DE); Paul Triebsch, Magdeburg (DE)

(73) Assignee: VOLKSWAGEN AKTIENGESELLSCHAFT, Wolfsburg (DE)

( * ) Notice: Subject to any disclaimer, the term of this patent is extended or adjusted under 35 U.S.C. 154(b) by 0 days.

(21) Appl. No.: 16/544,645

(22) Filed: Aug. 19, 2019

(65) Prior Publication Data

US 2020/0056573 A1 Feb. 20, 2020

(30) Foreign Application Priority Data

Aug. 20, 2018 (DE) ..... 10 2018 120 239

(51) Int. Cl.

*F02M 61/14* (2006.01)
*F02M 41/00* (2006.01)
*F02M 63/02* (2006.01)

(52) U.S. Cl.

CPC ..... *F02M 61/14* (2013.01); *F02M 41/00* (2013.01); *F02M 63/0275* (2013.01);
(Continued)

(58) Field of Classification Search

CPC ..... F02M 61/14; F02M 69/465; F02M 69/50; F02M 2200/09; F02M 2200/85;
(Continued)

(56) References Cited

U.S. PATENT DOCUMENTS 5,806,494 A 9/1998 Glassey
6,318,341 B1 11/2001 Gmelin et al.
(Continued)

FOREIGN PATENT DOCUMENTS

DE 198 53 090 A1 5/2000
DE 10 2006 000 290 A1 12/2006
(Continued)

*Primary Examiner* — Erick R Solis
(74) *Attorney, Agent, or Firm* — Pearl Cohen Zedek Latzer Baratz LLP

(57) ABSTRACT

The invention relates to an arrangement for connecting at least one fuel injection valve with a fuel distributor of a fuel injection system of an internal combustion engine, which fuel distributor is detachably fastened to a cylinder head, wherein the at least one fuel injection valve is detachably fastened by means of a fixing element to a mounting element of the fuel distributor. It is provided that a non-cylinder-facing surface of the mounting element of the fuel distributor and a cylinder-facing surface of the fixing element, in the assembled state of the cylinder head and fuel distributor and also the fuel injection valve, are configured as contact surfaces, by means of which, through attachment of the fixing element to the fuel injection valve, it is possible to bring about an axial fixing and a radial orientation of the fuel injection valve in the cylinder head and in the mounting element of the fuel distribution rail.

12 Claims, 1 Drawing Sheet

(52) U.S. Cl.
CPC ... *F02M 2200/09* (2013.01); *F02M 2200/851* (2013.01); *F02M 2200/852* (2013.01); *F02M 2200/855* (2013.01); *F02M 2200/856* (2013.01)

(58) Field of Classification Search
CPC ..... F02M 2200/851; F02M 2200/852; F02M 2200/855; F02M 2200/856
USPC ..... 123/470
See application file for complete search history.

(56) References Cited

U.S. PATENT DOCUMENTS

| | | | | |
|---|---|---|---|---|
| 7,516,735 | B1 * | 4/2009 | Doherty | F02M 55/005 123/468 |
| 9,157,401 | B2 * | 10/2015 | Stieler | F02M 55/004 |
| 9,546,627 | B2 * | 1/2017 | Okamoto | F02M 51/0671 |
| 2006/0137659 | A1 * | 6/2006 | Zdroik | F02M 69/042 123/470 |
| 2010/0275883 | A1 * | 11/2010 | Hohkita | F02M 55/025 123/456 |
| 2011/0030656 | A1 * | 2/2011 | Pepperine | F02M 61/14 123/470 |
| 2011/0186016 | A1 | 8/2011 | Bolz et al. | |
| 2013/0068199 | A1 * | 3/2013 | Cerny | F02M 51/005 123/470 |
| 2014/0123933 | A1 * | 5/2014 | Okamoto | F02M 51/0671 123/294 |
| 2015/0136086 | A1 | 5/2015 | Pohlman et al. | |

FOREIGN PATENT DOCUMENTS

| | | | |
|---|---|---|---|
| DE | 10 2008 002 122 | A1 | 12/2009 |
| DE | 10 2016 210 573 | A1 | 12/2017 |
| EP | 0 945 611 | A2 | 9/1999 |
| EP | 2 905 461 | A2 | 8/2015 |
| WO | WO 2013/170998 | A1 | 11/2013 |
| WO | WO 2016/020255 | A1 | 2/2016 |

* cited by examiner

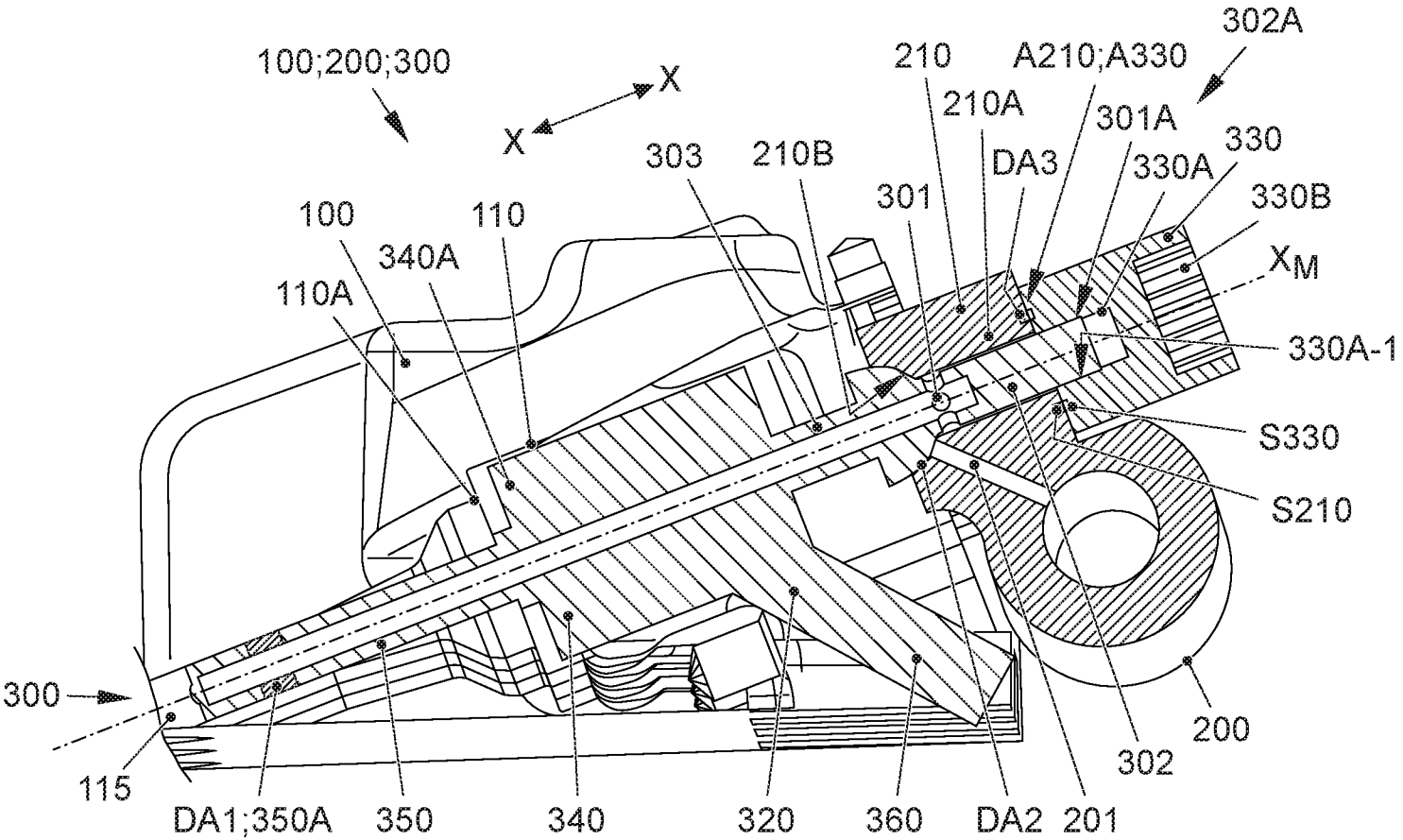
302A
A210;A330
210
210A
DA3
301A
330A
330
330B
$X_M$
330A-1
S330
S210
301
210B
303
X
X
100;200;300
100
110
340A
110A
200
302
201
DA2
360
320
340
350
DA1;350A
115
300

ARRANGEMENT OF A FUEL INJECTION VALVE ON A FUEL DISTRIBUTOR OF AN INTERNAL COMBUSTION ENGINE

CROSS-REFERENCE TO RELATED APPLICATIONS

This application claims priority from German Patent Application No. 10 2018 120 239.3, filed Aug. 20, 2018, which is hereby incorporated by reference in its entirety.

FIELD OF THE INVENTION

The invention relates to an arrangement for connecting at least one fuel injection valve with a fuel distributor of a fuel injection system of an internal combustion engine, which fuel distributor is detachably fastened to a cylinder head, wherein the at least one fuel injection valve is detachably fastened by means of a fixing element to a mounting element of the fuel distributor.

BACKGROUND OF THE INVENTION

Publication WO 2016/020255 A1 describes an arrangement for joining a connection part of a fuel injection valve with a cup of a fuel-conveying component, wherein a joining clamp is provided. In the assembled state, the joining clamp joins the connection part of the fuel injection valve to the cup. In this way, a contact contour provided on the connection part and a contact contour provided on the joining clamp, at which a contact between the connection part and the joining clamp is achieved in the assembled state, are adapted to one another in such a way that a bearing of the connection part on the joining clamp is guaranteed, enabling a swivelling of the connection part in relation to a longitudinal axis of the cup.

Moreover, a further arrangement for high-pressure injection in internal combustion engines is known from publication WO 2013/170998 A1. Said arrangement comprises a fuel distributor and several fuel injection valves. In this connection each of the fuel injection valves is arranged on a cup of the fuel distributor. At least one of the fuel injection valves is fastened to the associated cup by way of a retention element. The retention element has a support surface. The cup has on an underside a contact surface, by which the cup is supported, via a damping layer, on the support surface of the retention element. The retention element is fixed to the cup. The fuel injection valve also has a collar which is supported on the retention element. Damping of vibrations, and thus a reduction in noise emissions, is possible due to the damping layer.

Publication DE 10 2008 002 122 A1 discloses a downholder for a fuel injection device, which comprises at least one fuel injection valve, a receptacle bore for the fuel injection valve and a connecting fitting of a fuel distributor line. The downholder can be clamped between a shoulder of the fuel injection valve and an end surface of the connecting fitting. The downholder has a base element in the shape of a partial ring, from which an axially flexible hold-down clip extends, the clip having at least two webs, two oblique segments and two contact segments. The base element is designed as a partial ring which stands upright and whose wall thickness corresponds to the thickness of the sheet metal used. The base element makes a transition into the two webs of the hold-down clip in such a way that the sheet metal wide sides of the webs extending out from the plane of the base element are opposite from one another and the ends of the webs facing away from the base element are bent in such a way that the oblique segments extend out from the bent end areas of the webs so that the cut edges are now opposite from one another in the sheet metal.

The joining clamp from the arrangement according to publication WO 2016/020255 A1 and the downholder according to publication DE 10 2008 002 122 A1 are structures that are geometrically complicated to produce. The retention element according to publication WO 2013/170998 A1 is constructed already somewhat more simply with regard to the geometry.

A further arrangement for connecting at least one fuel injection valve to a fuel distributor of a fuel injection system of an internal combustion engine is found in publication DE 10 2016 210 573 A1, wherein the at least one fuel injection valve is detachably fastened to a cup of the fuel distributor by means of a retention element. The cup has at least one gap, which in the assembly situation makes a clamping collar of a connection element of the fuel injection valve accessible, since the connection element of the fuel injection valve is in the cup in the assembly situation, wherein the clamping collar is fixed in the cup in the assembly situation of clamping jaws of the retention element pushed into the gap.

Starting out from the prior art, the underlying object of the invention is to create another alternative advantageous connection between a fuel injection valve and a fuel distributor of an internal combustion engine.

SUMMARY OF THE INVENTION

The starting point of the invention is an arrangement for connecting at least one fuel injection valve with a fuel distributor of a fuel injection system of an internal combustion engine, which fuel distributor is detachably fastened to a cylinder head, wherein the at least one fuel injection valve is detachably fastened by means of a fixing element to a mounting element of the fuel distributor.

According to the invention, it is provided that a non-cylinder-facing surface of the mounting element of the fuel distributor and a cylinder-facing surface of the fixing element, in the assembled state of the cylinder head and fuel distributor and also the fuel injection valve, are configured as contact surfaces, by means of which, through attachment of the fixing element to the fuel injection valve, it is possible to bring about an axial fixing and a radial orientation of the fuel injection valve in the cylinder head and in the mounting element of the fuel distributor. Such a contact-surface positioning of the aforementioned components in relation to each other allows an exact positioning and is robust and easily reproducible.

It is preferably provided that the fixing element is a screw head, having a blind hole that is provided with an internal thread, said blind hole facing, in the assembled state, the non-cylinder-facing surface of the mounting element, wherein the cylinder-facing surface is configured around the blind hole of the fixing element.

Further, it is preferably provided that the internal thread of the blind hole corresponds to an external thread of a fuel nozzle of the fuel injection valve configured as threaded bolt.

In this way it is possible, preferably in an advantageous manner, for a through opening of the mounting element and the non-cylinder-facing surface of the mounting element in the assembled state to be orientated predefinably through fastening of the mounting element to the cylinder head, such that an arrangement of the fuel injection valve in an installation channel of the cylinder head and the through opening of the mounting element in a pre-position is possible, wherein the pre-positioning of the mounting element leads at the same time to a pre-positioning of the non-cylinder-facing surface of the mounting element.

According to the invention, the arrangement is characterised in that the fuel injection valve is arranged with little play and at the same time secured against rotation in the pre-position opposite the installation channel and the through opening opposite the mounting element of the fuel distributor, and the fuel nozzle of the fuel injection valve has a projection above the non-cylinder-facing surface.

Additionally, it is provided that the fixing element has a polygonal socket, into which a tool engages to perform a rotational movement of the fixing element, said rotational movement fixing the fuel injection valve to the mounting element. The polygonal socket is arranged on a side of the fixing element lying opposite the blind hole of the fixing element.

In the assembled state—with interposition of the mounting element of the fuel distributor—the fixing element is connected with the fuel injection valve (injector), which consists of the injector body and an injector tip, wherein the injector tip and injector body and fuel nozzle of the fuel injection valve and the blind hole and the polygonal socket of the fixing element lie on a common longitudinal axis.

Preferably, it is provided that the contact surfaces are flat surfaces, by means of which an axial fixing and radial orientation of the fuel injection valve in the cylinder head and on the cylinder head and respectively opposite the mounting element of the fuel distribution rail is brought about through the cylinder-facing surface of the fixing element being brought to lie opposite the previously pre-positioned non-cylinder-facing surface of the mounting element, which is axially clampable on the non-cylinder-facing surface of the mounting element by performing a rotational movement of the fixing element, wherein at the same time a radial orientation of the fuel injection valve takes place, since the contact surfaces also bring about an end positioning of the fuel injection valve through the axial clamping in an advantageous manner.

The following are provided:

a first gasket arrangement between the combustion chamber and the installation channel of the cylinder head, which is configured as a ring gasket which seals a tip of the fuel injection valve (injector tip) against the installation channel, and a second gasket arrangement between the through opening of the mounting element of the fuel distributor and the installation channel of the fuel injection valve, and a third gasket arrangement between the contact surfaces of the mounting element of the fuel distributor and of the fixing element, which are explained in more detail in the description.

According to the invention, a method is made available for producing an arrangement for connecting at least one fuel injection valve with a fuel distributor of a fuel injection system of an internal combustion engine, which fuel distributor is detachably fastened to a cylinder head, wherein the at least one fuel injection valve is detachably fastened by means of a fixing element to a mounting element of the fuel distributor, said method being characterised by the following assembly steps:

a) introducing a fuel injection valve into a cylinder head, into the opening (installation channel) provided for this in the cylinder head.

b) placing a fuel distributor onto a stud-like extension of the fuel injection valve configured as fuel nozzle via a through opening in a mounting element of the fuel distributor.

c) fixing the fuel distributor to the cylinder head, which serves as a mounting element for the fuel distributor.

d) fixing the fuel injection valve to the fuel distributor by means of a fixing element.

The invention relates to a fuel injection system of an internal combustion engine with an arrangement for connecting at least one fuel injection valve to a fuel distributor of the fuel injection system, wherein the at least one fuel injection valve is detachably fastened by means of a fixing element to a mounting element of the fuel distributor, wherein it is provided that a non-cylinder-facing surface of the mounting element of the fuel distributor and a cylinder-facing surface of the fixing element, in the assembled state of the cylinder head and fuel distributor and also the fuel injection valve, are configured as contact surfaces, by means of which, through attachment of the fixing element to the fuel injection valve, it is possible to bring about an axial fixing and a radial orientation of the fuel injection valve in and on the cylinder head and in the mounting element of the fuel distribution rail.

BRIEF DESCRIPTION OF THE DRAWINGS

The invention is explained below with reference to the associated drawing.

FIG. 1 shows a section through the longitudinal central axis of a fuel injection valve in its installation situation in a cylinder head with a cylinder head, likewise represented in section, and an associated fuel distributor (rail).

DETAILED DESCRIPTION OF THE INVENTION

First an arrangement concept of a fuel injection valve 300 in the cylinder head 100 is explained.

FIG. 1 shows a cylinder head 100 of an internal combustion engine in a sectional view through a central axis $X_M$ of a fuel injection valve 300, which is arranged in the cylinder head 100.

Arranged on the cylinder head 100, which serves as a mounting structure, is a fuel distribution system in the manner of a fuel distributor 200, in particular a fuel distribution rail—also referred to simply as a rail—on which several fuel injection valves 300 are mostly arranged, as shown in FIG. 1.

The fuel distribution rail 200 (rail) serves to store fuel that is under high pressure and to distribute the fuel to the several fuel injection valves 300, which are embodied in particular as high-pressure injection valves.

The high-pressure injection valves 300 and the fuel distribution rail 200 (rail) are designed for example for operating pressures of above 400 bar. The fuel injection valves 300 inject the fuel necessary for the combustion process under high pressure into a combustion chamber 115 of the internal combustion engine.

The fuel is compressed upstream of the fuel distribution rail 200 mostly by way of a high-pressure pump and conveyed under volume control via a high-pressure line into the fuel distribution rail 200.

From the fuel distribution rail 200 the fuel goes via a channel-like opening 201 from the rail to the fuel injection valves 300, which have a correspondingly adapted opening 301. In other words, the fuel flows via the openings 201, 301 from the rail 200 into the at least one fuel injection valve or the several fuel injection valves 300.

The arrangement is embodied in an advantageous manner as a fuel injection system for high-pressure injection in internal combustion engines, wherein the fuel injection system is provided in particular for mixture-compressing, spark-ignited internal combustion engines. The fuel injection system is especially suited for petrol direct injection, in particular of direct-injection exhaust gas-turbocharged petrol engines.

Per fuel injection valve 300 of the mostly multiple fuel injection valves 300 arranged on the fuel distribution rail 200, the fuel distribution rail 200 comprises a mounting element 210 in the manner of a cup 210 or a corresponding number of mounting elements 210.

A cup 210 is a component, in particular a cylindrical component, which has a through opening which is configured differently geometrically according to the invention in sections or cup sections 210A and 2108 along the longitudinal extent of the through opening, as will be described later in detail.

The subject-matter of the invention is an arrangement which serves to connect the fuel injection valve 300 with the cup 210 of the fuel-carrying component, in particular the fuel distribution rail 200.

The arrangement according to the invention is for example a fuel distribution rail 200, which is arranged laterally on a cylinder block, in particular a cylinder head 100 of the cylinder block.

The fuel distribution rail 200 is fastened in a fixed location on the cylinder head 100 by way of fastening elements, which are not represented in more detail.

In the lateral arrangement of the fuel distribution rail 200, the fuel injection valves 300 going off from the fuel distribution rail 200 are arranged substantially at a right angle in relation to the cylinder pistons in the cylinder block or—see FIGURE—leading obliquely downwards to the combustion chamber 115.

In the conventional lateral arrangement of one of the fuel injection valves 300, an injector body 340 of the fuel injection valve 300 is supported in the installation channel 110 of the cylinder head 100 embodied as a receptacle bore.

The hitherto existing support of the fuel injection valves 300 in the installation channel 110 of the cylinder head 100 was hitherto provided in a disadvantageous manner on a step 110A of the installation channel 110 of the cylinder head 100 via a step 340A of the injector body 340 of the fuel injection valve 300. The hitherto existing support of the fuel injection valve 300 in the cylinder head 100 leads to the introduction of structure-borne noise into the cylinder head 100 and the adjacent components such as a cylinder crankcase, a cylinder head cover and the fuel distribution rail 200.

With the lateral arrangement of the fuel injection valves 300 in the cylinder head 100, as presented here, the problem of the small available installation space to the side of the cylinder head 100 and at the same time the problem of the transmission of the structure-borne noise of the fuel injection valves 300 onto the cylinder head 100, in particular onto the adjacent components of the fuel injection valve 300 or the fuel injection valves 300, is solved, as will be described below in detail.

According to the invention, a fixing element 330 of the fuel injection valve 300, which fixing element is configured separate from the fuel injection valve 300, is the actual component for connecting the fuel injection valve 300 with the cup 210 of the fuel distribution rail 200 in a so-called assembled state, as will likewise be explained later.

An axial fastening region on the fuel injection valve 300 is embodied as a so-called fuel nozzle 301 of the fuel injection valve 300, so that the fuel injection valve 300 can be fastened by means of the fixing element 330 to the fuel distribution rail 200, in particular to the cup 210.

The fuel nozzle 302 is configured as a stud which, viewed in axial direction $X_M$, has in the assembled state a projection over the non-cylinder-facing surface A210 of the cup 210.

The stud 302 has at least in the region of the projection an external thread 302A.

In the assembled state the fuel injection valve 300 is positioned in the cup 210 in a fixed location and in particular secured against rotation, such that the non-cylinder-facing surface A210 of the cup 210 can serve, according to the invention, as a predefinable mounting surface, which is orientated predefinably in the three-dimensional space.

In the assembled state a fuel injection valve 300—after its assembly, which is still to be explained—is an assembly component which comprises the fuel injection valve 300 with a fuel nozzle 302 per se and the fixing element 330.

In the assembled state the fixing element 330 is connected with the fuel injection valve 300 (injector), which consists of the injector body 340 and an injector tip 350, which is mostly embodied cylindrically, as is made clear in FIG. 1.

Arranged on the injector tip 350 is a circumferential gasket 350A, which, for fuel-side sealing of the installation channel 110, guarantees in particular a fuel-side sealing of the injector tip 350 against the installation channel 110 of the cylinder head 100 and thus ultimately against the combustion chamber 115 in the cylinder block.

The fixing element 330, injector body 340 and injector tip 350 lie on an axis X, which is configured as a longitudinal central axis $X_M$ of the fuel injection valve 300.

The fuel injection valve 300 comprises a transition element 320, which goes off from the injector body, wherein the transition element 320 transitions into a socket element 360 (not represented in detail), via which electrical power is supplied to the fuel injection valve 300 to control the injection, which valve likewise protrudes slightly out of the cylinder head 100 of the internal combustion engine.

The fixing element 330 has a blind hole 330A, which in the assembled state faces the non-cylinder-facing surface A210 of the cup 210.

The blind hole 330A is provided with an internal thread 330A-1, which corresponds to the external thread 302A of the fuel nozzle 302, which fuel nozzle is configured as a threaded bolt.

Configured around the blind hole 330A in the assembled state is a cylinder-facing surface A330.

The non-cylinder-facing surface A210 (hereinafter also referred to as the cup-side contact surface) of the cup 210 and the cylinder-facing surface A330 (hereinafter also referred to as the fixing element-side contact surface) of the fixing element 330 form contact surfaces A210, A330, by means of which an axial fixing and radial orientation of the fuel injection valve 300 in the cylinder head 100 on the cup 210 of the fuel distribution rail 200 is brought about.

The fixing element 330 has a polygonal socket 330B, which, by means of a tool engaging in the polygonal socket 330B, allows a screwing movement of the fixing element 330 in relation to the fuel injection valve 300, which was previously pre-positioned so as to be secured against rotation in the cup 210.

The fuel injection valve 300 has little play in relation to the through opening in the cup 210 and the installation channel 110 in the cylinder head, such that, starting from the pre-positioning, which is secured against rotation, after the screwing movement of the fixing element 330 in relation to the cup 210 is carried out, there is an axial end orientation and an axial end positioning of the fuel injection valve 300 in relation to the cup 210 and in relation to the installation channel 110 in the cylinder head 100.

Further, starting from the pre-positioning, which is secured against rotation, of the fuel injection valve 300 in the cup 210, after the screwing movement of the fixing element 330 in relation to the cup 210 is carried out, there is a radial end orientation and a radial end positioning via the cup-side and the fixing element-side contact surfaces A210, A330.

In other words, screwing the fixing element 330 brings about a two-dimensional end orientation and end positioning of the fuel injection valve 300 in the cylinder head 100 with the aid of the positioned and correspondingly orientated cup 210 on the cylinder head 100, which cup is arranged between the cylinder head 100 and fixing element 330.

An axial end orientation and axial end positioning of the fuel injection valve 300 occur axially in the longitudinal extent $X_M$ and a radial end orientation and a radial end positioning of the longitudinal axis of the fuel injection valve 300 occur inside the installation channel in the cylinder head and inside the through openings in the cup sections 210A and 210B of the cup 210 through orientation of the longitudinal axis in radial direction.

Following on from this, for further explanation, an associated sealing and assembly concept for the fuel injection valve 300 is explained.

The assembly took place in such a way that the fuel injection valve 300 is introduced into the installation channel 115 before assembly of the fuel distribution rail 200. In this connection the fuel nozzle 302 protrudes out of the cylinder head 100.

In this connection the fuel injection valves 300 are pre-positioned autonomously over the injector tip 350 in the installation channel 110 during insertion of the fuel injection valves 300 in such a way that the injector tip 350 comes into contact with the installation channel 110 only with the gasket 350A, while the injector body 340 has no contact points at all with the installation channel 110. The ring gasket is a first gasket arrangement DA1 between the combustion chamber 115 and the installation channel 115 of the cylinder head 100.

The structure-borne noise of the injector 300 is thus now transmitted only slightly from the injector tip 350 to the cylinder head 100 via the gasket 350, which damps structure-borne noise.

In an advantageous manner, an appropriate spacing is formed further between the injector body 340 and the installation channel 110, said spacing preventing a direct transmission, in particular a direct transmission of sound waves from the injector body 340 to the cylinder head 100.

In this connection, the connection inside the first gasket arrangement DA1 is still flexible in such a way that the spacing within certain tolerances between the longitudinal axis of the installation channel 110 in the cylinder head 100 and the longitudinal central axis $X_M$ of the fuel injection valve 300 can be matched to one another through fixing by means of the fixing element 330.

Subsequently, the through opening of the cup 210 of the fuel distribution rail 200 is pushed onto the fuel nozzle 302 in such a way that only the projection of the fuel nozzle 302 still protrudes on the non-cylinder-facing side of the cup 201.

The through opening, which is configured in sections or cup sections 210A and 210B of the cup 210, likewise has only a little play in relation to the lateral surface of the fuel nozzle 302, such that the previously described pre-alignment or pre-positioning of the fuel injection valve 300 occurs, wherein the cup 210 of the fuel distribution rail 200 is fastened at a position provided for this inside the cylinder head, as is not represented in more detail.

At the same time as the cup 210 is placed on the fuel nozzle 302, the pre-positioned fuel injection valve 300 is secured against rotation on the cup 210.

Subsequently, the fuel injection valve 300 is fixed using the fixing element 330.

The fixing element 330 is screwed with its internal thread 330A-1 onto the external thread 302A of the fuel nozzle, such that the contact surfaces A210, A330 come into contact, wherein the screwing action brings about an axial torque, as a result of which the fuel injection valve 300 is brought axially into its end position.

The radial orientation of the longitudinal central axis $X_M$ of the fuel injection valve 300 in relation to the longitudinal axis of the installation channel 110 comes about by way of the contact surfaces A210, A330, such that the fuel injection valve 300 is also brought radially into its end position.

In other words, the longitudinal central axis $X_M$ of the fuel injection valve 300 can be displaced by a small angular amount after the pre-positioning in relation to the longitudinal axis of the installation channel 110, as a result of which a straight seating of the fuel injection valve 300 in the installation channel 110 is always guaranteed, as a result of which contact points between the injector body 340 and the installation channel 110 of the cylinder head 100 are reliably avoided.

In summary, according to the invention a very simple and reliable, almost play-free fastening of the fuel injection valve 300 to the fuel distribution rail 200 is achieved, which fastening is at the same time secured against rotation, and which is able, within the framework of the tolerances that are available or are consciously made available during the pre-positioning, to even out, in the assembled state, the existing tolerances of the interconnected components, wherein the connection requires only a small installation space overall.

The connection requiring a small installation space is of particular advantage above all in the case of a lateral injector position, as has been explained already. The connection also ensures that high pressures of more than 400 bar can be applied on the fuel injection valve 300, as the tightening element of the fixing element 330 provides not only the forces for the end orientation, but also the forces for the sealing of a second gasket arrangement DA2 and of a third gasket arrangement DA3.

The second gasket arrangement DA2 ensures a seal between the through opening in the cup and the installation channel 115.

The third gasket arrangement DA3 ensures a seal between the contact surfaces A210, A330 of the cup 210 and the fixing element 330.

The following sealing systems are proposed and can be used for both gasket arrangements DA2, DA3, or two of the sealing systems mentioned below are used in combination for one or the other gasket arrangement in combination.

The following sealing systems can be used: a taper-cone seating, a hemisphere-cone seating, a metal beaded gasket, a biting edge, bonding, an O-ring, a hemp tape or a non-ferrous-metal sealing ring.

To clarify the gasket arrangements according to the invention, an exemplary embodiment is represented in FIG. 1, in which the second gasket arrangement DA2 is configured as a taper-cone seating and the third gasket arrangement DA3 is configured as a metal beaded gasket.

In the case of the second gasket arrangement DA2, the second cup section 2108 of the through opening of the cup 210 is configured in a tapered shape, such that a taper on the fuel injection valve 300 formed between an intermediate nozzle 303 and the fuel nozzle 302 engages in the assembled state into the tapered through opening of the second cup section 210B, as a result of which the corresponding seating is formed. The second cup section 210B transitions into the first cup section 210A, which is cylindrical and forms the fuel nozzle 302 on the end side. It should be understood that the intermediate nozzle 303 does not necessarily have to be arranged between the injector body 340 and taper.

The third gasket arrangement DA3 comes about in the exemplary embodiment by way of the metal beaded gasket, wherein beads S210 and S330, situated opposite each other in the cup 210 and circumferentially in the fixing element 330, are configured in the opposing contact surfaces A210, A330. Inserted in at least one of the beads S210 and S330 is a sealing element, in particular a copper gasket, which after corresponding attachment of the fixing element 330 and clamping of the fuel injection valve 300, as already explained above, ensures tightness between the cup 210 and fixing element 300.

The invention thus creates a possibility for the easily embodied axial fixing and radial orientation of the fuel injection valve 300 in combination with the sealing of the fuel injection valve 300 in relation to the fuel distribution rail 300 and also a low-noise arrangement of the fuel injection valve 300 in the installation channel 110.

In summary, the assembly is based on the following steps: a) introducing the fuel injection valve 300 into the cylinder head 100, into the opening provided for this in the cylinder head 100, and b) placing the fuel distribution rail 200 via the through opening in the fuel distribution rail 200 onto the stud-like extension of the fuel injection valve 300 referred to as a fuel nozzle 302, and c) fixing the fuel distribution rail 200 to the cylinder head 100, which serves as a mounting element for the fuel distribution rail 200, and finally d) fixing the fuel injection valve 300 by means of the fixing element 330 in the manner of a screw head to the fuel distribution rail 200.

LIST OF REFERENCE SIGNS

100 cylinder head
110 installation channel
110A step
115 combustion chamber
200 fuel distributor
201 opening
210 mounting element, cup
210A first cup section with cylindrical opening
210B second cup section with tapered or conical opening
A210 non-cylinder-facing surface (cup-side contact surface)
S210 bead (on cup side)
300 fuel injection valve
301 opening
302 fuel nozzle
302A external thread
303 intermediate nozzle
320 transition element
330 fixing element
330A blind hole
330A-1 internal thread
A330 cylinder-facing surface (fixing element-side contact surface)
S330 bead (on the fixing element side)
340 injector body
340A step
350 injector tip
350A gasket
DA1 first gasket arrangement
DA2 second gasket arrangement
DA3 third gasket arrangement
$X_M$ longitudinal central axis of the fuel injection valve 300 and of the cup 210 and also of the fixing element 330

The invention claimed is:

1. An arrangement for connecting at least one fuel injection valve with a fuel distributor of a fuel injection system of an internal combustion engine, wherein the fuel distributor is detachably fastened to a cylinder head, the arrangement comprising:

a fixing element detachably fastening the at least one fuel injection valve to a mounting element of the fuel distributor, wherein a non-cylinder-facing surface of the mounting element of the fuel distributor and a cylinder-facing surface of the fixing element, in the assembled state of the cylinder head and fuel distributor and also the at least one fuel injection valve, are configured as contact surfaces, by means of which, through attachment of the fixing element to the at least one fuel injection valve, it is possible to bring about an axial fixing and a radial orientation of the at least one fuel injection valve in the cylinder head and in the mounting element of the fuel distributor, wherein the fixing elements has polygonal socket, into which a tool engages to perform a rotational movement of the fixing element, said rotational movement fixing the at least one fuel injection valve to the mounting element.

2. The arrangement according to claim 1, wherein the fixing element is a screw head which has a blind hole which is provided with an internal thread, which, in the assembled state, faces the non-cylinder-facing surface of the mounting element, wherein the cylinder-facing surface is configured around the blind hole of the fixing element.

3. The arrangement according to claim 2, wherein the internal thread of the blind hole corresponds to an external thread of a fuel nozzle of the fuel injection valve, which fuel nozzle is configured as a threaded bolt.

4. The arrangement according to claim 1, wherein a through opening of the mounting element and the non-cylinder-facing surface of the mounting element in the assembled state is orientated predefinably through fastening of the mounting element to the cylinder head, such that an arrangement of the fuel injection valve in an installation channel of the cylinder head and the through opening of the mounting element in a pre-position is possible, wherein the pre-positioning of the mounting element leads simultaneously to a pre-positioning of the non-cylinder-facing surface of the mounting element.

5. The arrangement according to claim 1, wherein, when the at least one fuel injection valve is fixed to the mounting element, the at least one fuel injection valve is secured against rotation in the pre-position opposite the installation channel and the through opening opposite the mounting element of the fuel distributor, and wherein the fuel nozzle of the fuel injection valve has a projection above the non-cylinder-facing surface.

6. The arrangement according to claim 1, wherein the contact surfaces are flat surfaces by means of which an axial fixing and radial orientation of the fuel injection valve in the cylinder head and on the mounting element is brought about through the cylinder-facing surface of the fixing element being brought to lie opposite the pre-positioned non-cylinder-facing surface of the mounting element and being axially clampable by performing a rotational movement of the fixing element, wherein, at the same dine, a radial orientation of the fuel injection valve takes place, since the contact surfaces bring about an end positioning of the fuel injection valve through the axial clamping.

7. The arrangement according to claim 1, further comprising a first gasket arrangement arranged between the combustion chamber and an installation channel of the cylinder head, said gasket arrangement being configured as a ring gasket which seals a tip of the fuel injection valve in relation to the installation channel.

8. The arrangement according to claim 7, further comprising a second gasket arrangement arranged between the through opening of the mounting element of the fuel distributor and an installation channel of the fuel injection valve.

9. The arrangement according to claim 8, further comprising a third gasket arrangement arranged between the contact surfaces of the mounting element of the fuel distributor and the fixing element.

10. The arrangement according to claim 9, wherein the second and third gasket arrangements are configured as taper-cone seating, as hemisphere-cone seating, as metal beaded gasket, as biting edge, as bonded joint, as O-ring, as hemp tape seal or as non-ferrous-metal sealing ring, and wherein the second and third gasket arrangements are configured as identical sealing systems or different sealing systems.

11. A method for producing an arrangement according to claim 1, comprising:

introducing a fuel injection valve into a cylinder head, into the opening provided for this in the cylinder head, placing a fuel distributor via a through opening in a mounting element of the fuel distributor onto a stud-like extension of the had injection valve configured as a fuel nozzle, and fixing the fuel distributor to the cylinder head, which serves as a mounting element for the fuel distributor, and fixing the fuel injection valve by means of a fixing element to the fuel distributor.

12. A fuel injection system of an internal combustion engine with an arrangement for connecting at least one fuel injection valve to a fuel distributor of the fuel injection system, wherein the at least one fuel injection valve is detachably fastened by means of a fixing element to a mounting element of the fuel distributor, wherein a non-cylinder-facing surface of the mounting element of the fuel distributor and a cylinder-facing surface of the fixing element, in the assembled state of the cylinder head and fuel distributor and also the at least one fuel injection valve, are configured as contact surfaces, by means of which, through attachment of the fixing element to the at least one fuel injection valve, it is possible to bring about an axial fixing and a radial orientation of the at least one fuel injection valve in the cylinder head and in the mounting element, wherein the fixing element has a polygonal socket, into which a tool engages to perform a rotational, movement of the fixing element, said rotational movement fixing the at least one fuel injection valve to the mounting element.

* * * * *